US006212349B1

(12) United States Patent
Labombard

(10) Patent No.: US 6,212,349 B1
(45) Date of Patent: Apr. 3, 2001

(54) CERAMIC DONOR ROLL WITH SHAFT

(75) Inventor: Richard G. Labombard, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/363,885

(22) Filed: Jul. 30, 1999

(51) Int. Cl.[7] ..... G03G 15/08
(52) U.S. Cl. ..... 399/286; 492/18
(58) Field of Search ..... 399/286, 266, 399/279, 290, 291; 492/16, 18

(56) References Cited

U.S. PATENT DOCUMENTS

| | | | | |
|---|---|---|---|---|
| 3,720,808 | * | 3/1973 | Morrissey | 219/469 |
| 4,242,782 | * | 1/1981 | Hanneken et al. | 432/246 |
| 4,399,598 | * | 8/1983 | Page et al. | 432/246 |
| 4,468,299 | | 8/1984 | Byrne et al. | 204/60 |
| 4,776,070 | | 10/1988 | Shibata et al. | 29/130 |
| 4,806,160 | | 2/1989 | Hagiwara et al. | 106/1.12 |
| 4,864,343 | | 9/1989 | Nelson | 354/304 |
| 4,868,600 | | 9/1989 | Hays et al. | 355/259 |
| 4,874,674 | | 10/1989 | Oda et al. | 428/469 |
| 4,944,977 | * | 7/1990 | Shantz et al. | 428/36.92 |
| 4,962,002 | | 10/1990 | Yoshida et al. | 428/609 |
| 4,984,019 | | 1/1991 | Folkins | 355/215 |
| 5,010,367 | | 4/1991 | Hays | 355/247 |
| 5,063,875 | | 11/1991 | Folkins et al. | 118/651 |
| 5,129,784 | | 7/1992 | Yoshikawa et al. | 415/216.1 |
| 5,144,885 | | 9/1992 | Suzuki et al. | 92/222 |
| 5,168,841 | | 12/1992 | Suzuki et al. | 123/90.48 |
| 5,194,050 | | 3/1993 | Muraishi et al. | 474/101 |
| 5,322,970 | * | 6/1994 | Behe et al. | 399/291 |
| 5,473,418 | | 12/1995 | Kazakos et al. | 355/259 |
| 5,585,909 | | 12/1996 | Behe et al. | 355/285 |

FOREIGN PATENT DOCUMENTS 4-258388 * 9/1992 (JP) .

OTHER PUBLICATIONS

Welding Handbook, vol. 2, Welding Proceses, Americal Welding Society, pp. 739–749.

* cited by examiner

*Primary Examiner*—Quana M. Grainger
(74) *Attorney, Agent, or Firm*—Andrew D. Ryan

(57) ABSTRACT

A roller is provided. The roller includes a ceramic body, an aluminum member attached to the ceramic body, and a shaft attached to the aluminum member.

19 Claims, 6 Drawing Sheets

CERAMIC DONOR ROLL WITH SHAFT

This invention relates generally to a development apparatus used in ionographic or electrophotographic imaging and printing apparatuses and machines, and more particularly is directed to donor rolls for a development system.

One common element utilized in machinery is a roll. The roll typically includes a body and two journals or stems which extend outwardly from opposed ends of the body. Bearings, either in the form of journals or rolling element bearings, permit the rotatable mounting of the rolls onto a frame of the machinery. The bearings are typically mounted to the outer periphery of the journals of the roll. These rolls, particularly those for use in precision equipment, may be expensive and difficult to manufacture. One particular type of machinery that utilizes rolls to a great extent is that of a printing machine. In a printing machine, a substrate typically in the form of a paper roll or cut paper sheets are fed through various steps in the printing process. The substrate is guided along a paper path by rolls and processing steps are often applied to the substrate through the use of rolls.

Generally, the process of electrophotographic printing includes charging a photoconductive member to a substantially uniform potential so as to sensitize the surface thereof. The charged portion of the photoconductive surface is exposed to a light image from either a scanning laser beam or light flashed upon an original document being reproduced. This records an electrostatic latent image on the photoconductive surface. After the electrostatic latent image is recorded on the photoconductive surface, the latent image is developed.

Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image-on-image processing, superimposes toner powder images of different color toners onto the photoreceptor prior to the transfer of the composite toner powder image onto the substrate. While the image on image process is beneficial, it has several problems. For example, when recharging the photoreceptor in preparation for creating another color toner powder image, it is important to level the voltages between the previously toned and the untoned areas of the photoreceptor. Moreover, the viability of printing system concepts such as image-on-image processing usually requires development systems that do not scavenge or interact with a previously developed image. Several known development systems, such as conventional magnetic brush development and jumping single component development, are interactive with the image bearing member, making them unsuitable for use with image-on-image processes.

One particular version of a scavengeless development system uses a plurality of electrode wires closely spaced from a toned donor roll. The donor roll is loaded with toner using conventional two component magnetic brush development. An AC voltage is applied to the wires to generate a toner cloud in the development zone. The electrostatic fields from the latent image attract toner from the toner cloud to develop the latent image.

Since hybrid scavengeless development relies on a continuous, steady toner powder cloud at the nip between the latent image and the donor roller, the speeds at which the rollers operate are significantly higher and the accuracy requirements are much more precise.

The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al, these references are totally incorporated herein by reference.

For proper operation of a donor roll in a hybrid scavengeless development, the diameter tolerance, runout and surface finish requirements of the donor roll are very critical and require very precise dimensions. Furthermore, donor rolls typically have a long length and a small diameter. For example, donor rolls may have a length of, for example, 18 to 24 inches and a diameter from 1 to 1½ inches.

Precision rolls, whether for use as a donor roll or for another purpose, are typically made by machining a body from a solid cylindrical stock. To provide for journals at opposing ends of the rolls, typically a hole or counterbore is machined in each of the opposed faces of the cylindrical body. Journals are machined from smaller cylindrical stock and are cut to length and fitted into the counterbored apertures in the opposed ends of the cylindrical body.

The processes of counterboring a solid body, of machining cylindrical journals and of inserting the cylindrical journals into the body have several major disadvantages, particularly when used to manufacture a large quantity of high-quality, precision rolls.

Precision rolls, such as those for a donor roll, require a outer periphery that has precision size, roundness and runout requirements with respect to the journals to which bearings are mounted to provide for rotation of the roll. As the roll is rotated about the journals of the roll, the outer periphery of the roll may have an eccentric pattern or runout with respect to the mounting journals. For the proper operation of a donor roll, the runout requirements may be as precise as to be within 0.000,025 meters (25 microns). Obtaining such a low runout is very difficult when utilizing the process steps of counterboring of the body and inserting journals in the counterbores.

Runout measured between the solid body periphery and the counterbore inside diameter must be added to the roundness measured of the solid body as well as to the roundness measured of the journals to accumulate the runout of the assembled roll.

Donor rolls in hybrid scavengeless development systems require certain semiconductive electrical properties for the proper formation of the toner cloud required to develop the latent image. Such semiconductive electrical properties are obtained either through the use of an anodized coating over an aluminum donor roll or by the use of a ceramic coating placed over an aluminum donor roll. A more complete description of the ceramic coating for a donor roll is described more fully for example in U.S. Pat. No. 5,473,418 to Kazakos et al.

The use of a ceramic coating greatly compounds the difficulty in providing an accurate precision donor roll. The application of a ceramic coating to an aluminum donor roll is very expensive in that the ceramic material itself is somewhat expensive and in the fact that the coating process for applying a coating of ceramic to a donor roll is very expensive. A typical process for the application of the ceramic is a thermal spray process. Such thermal spray processes include for example a plasma spray. A thermal spray process causes oxides to form in the ceramic layer.

The oxides form in a somewhat unpredictable manner. Oxides in the ceramic coating result in porosity within the ceramic layer. The oxides produced through the thermal spray process cause porosity in the ceramic layer. This porosity creates problems in obtaining the required surface finish for proper operation of a ceramic roll. Further, the porosity in the surface may lead to arcing between the wires in the donor roll.

The oxides formed in the thermal spray process of the ceramic coating determine or assist in determining the electrical properties, namely the time constant, of the donor roll. Inconsistencies within a donor roll and from donor roll based upon the problems in obtaining consistent oxides through the thermal spray process may cause variations and inconsistencies in the types and quantity of oxides formed in the ceramic process thereby causing variations in the time constant or electrical properties of the donor roll.

Because the thermal spray process is inaccurate and expensive, the outer periphery of the donor roll must be machined after the thermal spraying process. Since the thermal spraying process is so time consuming and expensive and since the thickness of the layer of around 180 microns must be maintained at a minimum level, the donor roll periphery must be very accurately machined both prior to the thermal spraying operation as well as after the thermal spraying operation. Thus two very slow time consuming expensive grinding operations, namely grinding operations before and after the thermal spraying process, must be performed. These added precision grinding operations increase the cost and difficulty in obtaining a quality donor roll.

Attempts to reduce the runout from this process include subsequent machining or grinding of the outer periphery of the body while rotating the body about the assembled journals. This additional machine step adds cost to the manufacturing of the donor rolls.

In addition to the increased difficulty in obtaining a precision roll from the prior art process of an assembled roll, the use of an assembled roll is very expensive. For example, not only must a solid cylindrical body be manufactured but the journals must be separately manufactured. Further, the counterbores on the ends of the solid body must be machined. Further, the journals must be accurately machined to fit the bores on the solid body. Also the journals must be assembled into the bores by the use of an appropriate technique, such as press fitting or shrink fitting the journals within the bores.

In addition to the cost and difficulty in manufacturing such an assembled roll, the use of an assembled roll can cause quality problems in that if the press fit process or the shrink fit process is not properly performed, the solid body may become loose from the journals requiring the replacement of the roll.

The machining processes to prepare the journals, the solid body and the assembled donor roll require that the components and assemblies be located in difficult manners during the machining steps. The relocations or transfers of the locating points of the different parts and assemblies of the donor roll lower the quality in the form of roundness concentricities, coating thickness uniformity, and cylindricity of the donor roll complicating the difficulty in obtaining a quality donor roll.

The roll of the present invention is intended to alleviate at least some of the above-mentioned problems.

The following disclosures may be relevant to various aspects of the present invention:

U.S. Pat. No. 5,585,909

Inventor: Behe et al.
Issue Date: Dec. 17, 1996

U.S. Pat. No. 5,473,418

Inventor: Kazakos et al.
Issue Date: Dec. 5, 1995

U.S. Pat. No. 5,194,050

Inventor: Muraishi et al.
Issue Date: Mar. 16, 1993

U.S. Pat. No. 5,168,841

Inventor: Suzuki, et al.
Issue Date: Dec. 8, 1992

U.S. Pat. No. 5,144,885

Inventor: Suzuki, et al.
Issue Date: Sep. 8, 1992

U.S. Pat. No. 5,129,784

Inventor: Yoshikawa, et al.
Issue Date: Jul. 14, 1992

U.S. Pat. No. 5,063,875

Inventor: Folkins et al.
Issue Date: Nov. 12, 1991

U.S. Pat. No. 5,010,367

Inventor: Hays, et al.
Issue Date: Jan. 8, 1991

U.S. Pat. No. 4,984,019

Inventor: Folkins
Issue Date: Jan. 8, 1991

U.S. Pat. No. 4,962,002

Inventor: Yoshida, et al.
Issue Date: Oct. 9, 1990

U.S. Pat. No. 4,874,674

Inventor: Oda et al.
Issue Date: Oct. 17, 1989

U.S. Pat. No. 4,868,600

Inventor: Hays et al.
Issue Date: Sep. 19, 1989

U.S. Pat. No. 4,864,343

Inventor: Nelson
Issue Date: Sep. 5, 1989

U.S. Pat. No. 4,806,160

Inventor: Hagiwara, et al.
Issue Date: Feb. 21, 1989

U.S. Pat. No. 4,776,070

Inventor: Shibata et al.

Issue Date: Oct. 11,1988

U.S. Pat. No. 4,468,299

Inventor: Byrne et al.

Issue Date: Aug. 28, 1984

Welding Handbook

Volume 2—Welding Processes, pp. 739–749

American Welding Society—1999

The relevant portions of the foregoing disclosures may be briefly summarized as follows:

U.S. Pat. No. 5,585,909 discloses a heating device, which can be used in the fixing unit of an image forming apparatus, such as an electrophotographic copying or printing machine, for fixing a toner image on a final substrate. The heating device which is in the form of a heated fuser roller is provided with bands or coatings of material which impede the transfer of heat from the fuser roller to bearing structure associated therewith. The bands or coatings are applied by plasma spraying a ceramic material on either the surface of a fuser roll core or on journals of end caps, depending upon the specific construction of the fuser roller.

U.S. Pat. No. 5,473,418 discloses a donor roll having a ceramic coating for use with an electrode structure in a scavangeless development unit of an electrostatographic printer. The ceramic coating consists essentially of a suitable mixture of alumina and titania by weight giving the donor roll a desired resistivity.

U.S. Pat. No. 5,194,050 discloses a positioning device for preventing an endless belt passed over a plurality support rollers from being shifted to either of opposite sides in the axial direction of the rollers. A pair of forcing elements are located at both ends of at least one of the support rollers for forcing back, when the belt is shifted toward either of opposite ends of the support roller to contact the end of the latter, the belt toward the center of the roller in the axial direction of the roller. The forcing elements each are implemented as a plurality of spaced flanges. The maximum diameter of the flanges sequentially increases from the innermost flange to the outermost flange in the axial direction of the roller. The plurality of flanges may be replaced with a single spiral flange.

U.S. Pat. No. 5,168,841 discloses a tappet for an internal combustion engine comprises a tappet main body and a ceramic seat plate. The tappet main body is constituted by axially separated first and second parts which are made of different metallic materials. The first part is for installation in a hole of a cylinder block for sliding therein. The second part is for installation between a push rod and a cam. The metallic material for the second part is more wear-resistant than that of the first part. The ceramic seat plate is brazed to the second part, and the first and second parts are joined together by welding such as electron beam welding, laser beam welding, etc.

U.S. Pat. No. 5,144,885 discloses a ceramic-metal friction welded member includes a ceramic member formed with an annular notch in an outer circumference of its surface and a metal member joined onto the annular notch of the ceramic member by friction welding. A ceramic cast-in bonded piston includes a crown made of a ceramic material having an annular notch formed in an outer circumference of its surface, a metal annular member joined onto the annular notch of the crown by friction welding, and a piston main body made of an aluminum alloy surrounding the crown by cast-in bonding. A ceramic cast-in bonded piston includes a crown made of a ceramic material, a piston main body made of an aluminum alloy surrounding the crown by cast-in bonding, and an annular member made of a metal different from aluminum and joined by friction welding to an outer circumference of a surface of the crown in contact with the piston main body.

U.S. Pat. No. 5,129,784 discloses in a ceramic rotor and metal shaft assembly, a ceramic rotor which has a protruded portion and is joined at the protruded portion to a recessed portion of a metal shaft by shrinkage fit or the like fitting method of fixedly holding the protruded and recessed portions relative to each other by making the mating circumferential surfaces of the protruded and recessed portions pressed against each other. The recessed portion has a minimum thickness wall between a circumferential wall and a bottom wall. The protruded and recessed portions have a set relationship of $0.05 \leq t/d \leq 0.2$ where t is a thickness of the minimum wall portion of the recessed portion and D is an outer diameter of the protruded portion.

U.S. Pat. No. 5,063,875 discloses an apparatus which develops an electrostatic latent image. A transport roll advances developer material from a chamber to a donor roll. The donor roll advances the toner particles to the latent image. The latent image attracts toner particles from the donor roll. In order to improve the speed with which toner particles removed from the donor roll are replaced, an alternating voltage is applied between the two rolls. The magnetic transport roll is driven to rotate at a surface velocity at least 2, but not more than 5 times that of the rotational surface velocity of the donor roll. Also, the compression pile height (CPH) vs. the spacing between the spacing between the donor roll and the transport roller (DRS) is found to be optimal when meeting the ratio CPH:DRS=2:3.

U.S. Pat. No. 5,010,367 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image.

U.S. Pat. No. 4,984,019 discloses an apparatus in which an contaminants are removed from an electrode positioned between a donor roller and a photoconductive surface. A magnetic roller is adapted to transport developer material to the donor roller. The electrode is vibrated to remove contaminants therefrom.

U.S. Pat. No. 4,962,002 discloses ceramic-metal composite bodies and a process for the production thereof. The ceramic-metal composite body includes a metallic member and a ceramic member which are integrally joined together by fitting a projection formed on the ceramic member to a recess formed in the metallic member. The projection of the ceramic member is fitted and joined into the recess of the metallic member in a vessel of which the inside is kept at an atmosphere having a pressure lower than an atmospheric pressure. The pressure of air remaining in a space left between the recess and the fitted projection is lower than that of the air in the space when the projection is fitted into the recess in the atmospheric pressure. An apparatus for fitting and joining the projection of the ceramic member to the recess of the metallic member is also disclosed, which includes a pressure-reducible vessel which is provided with a space for receiving at least the projection of the ceramic member and the recess of the metallic member, a sealing structure including O-rings or the like, a pipe opening for exhausting air inside the vessel, and a movable push rod for pressing and fitting the projection of the ceramic member into the recess of the metallic member.

U.S. Pat. No. 4,874,674 discloses a metal-ceramic composite body which is produced by fitting a protruding portion of a ceramic member into a concave portion of an intermediate member and joining the intermediate member to a metallic member. In this case, a difference between the inner diameter in the concave portion of the intermediate member and the outer diameter in the protruding portion of the ceramic member is not less than 0.2% of the outer diameter in the protruding portion when the protruding portion is pulled out from the concave portion.

U.S. Pat. No. 4,868,600 discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

U.S. Pat. No. 4,864,343 discloses a pressure roll is disclosed particularly for fixing and developing sheet material which is treated by passing through a high pressure nip defined by a pair of the rolls. The roll includes a support shaft and a cylindrical roll body secured to the shaft. To produce a uniform force along the pressure nip when a pair of the rolls are placed under load, the body is formed from a body material having a modulus of elasticity which varies as a function of position along the length of the body. The body is encased in a cylindrical shell.

U.S. Pat. No. 4,806,160 discloses a metallizing composition comprising an oxynitride glass of the Mg—Al—Si system and/or the Y—Al—Si system and a powder of a high-melting-point metal. This composition has a good affinity with a nitride ceramic material and a carbide ceramic material and is useful for forming metallized layers on substrates of these ceramic materials U.S. Pat. No. 4,776,070 discloses a roller which has a roller body having a small electrical resistivity, a bonding layer formed substantially uniformly on the outer peripheral surface of the roller body, a lower insulating layer provided on the bonding layer; a heat generating layer provided on the lower insulating layer and a ceramic matrix and a metallic resistance layer, constituted by a metal dispersed in the ceramic matrix. The metallic resistance layer extends substantially continuously in the lengthwise direction of the roller, a heat generating layer. The roller has an upper insulating layer provided on the heat generating layer, a protective layer formed on the upper insulating layer so as to prevent offset of the toner images, an electrode layer formed on each end of the roller and adapted to connect the heat generating layer to an external power source; and side protective layers covering at least the side surface of the heat generating layer, and the side surfaces and the axially outside surfaces of the lower insulating layer.

U.S. Pat. No. 4,468,299 discloses a nonconsumable electrode assembly suitable for use in the production of metal by electrolytic reduction of a metal compound dissolved in a molten salt, the assembly comprising a metal conductor and a ceramic electrode body connected by a friction weld between a portion of the body having a level of free metal or metal alloy sufficient to effect such a friction weld and a portion of the metal conductor.

The Welding Handbook, Volume 2, Welding Processes, describes solid state welding and friction welding in particular.

SUMMARY OF THE INVENTION

In accordance with one aspect of the present invention, there is provided a roller. The roller includes a ceramic body, an aluminum member attached to the ceramic body, and a shaft attached to said aluminum member.

In accordance with another aspect of the present invention, there is provided a development roller for use in a machine in which marking particles are advanced toward a latent image to form a developed image. The development roller includes a body, a member frictionally welded to the body, and a shaft attached to the member.

In accordance with a further aspect of the present invention, there is provided a development unit for use in a printing machine in which marking particles are advanced toward a latent image to form a developed image. The development unit includes a housing defining a chamber therein for storing a supply of marking particles therein. The housing defines an aperture therein and a development roller. The roller is rotatably mounted to the housing and positioned adjacent the aperture. The development roller is adapted to advance the marking particles from the chamber toward the latent image. The development roller includes a body, a member frictionally welded to said body, and a shaft attached to said member.

In accordance with yet another aspect of the present invention, there is provided an electrophotographic printing machine of the type in which marking particles are advanced toward a latent image to form a developed image. The printing machine includes a development unit. The development unit includes a housing defining a chamber therein for storing a supply of marking particles therein. The housing defines an aperture therein and a development roller. The roller is rotatably mounted to the housing and positioned adjacent the aperture. The development roller is adapted to advance the marking particles from the chamber toward the latent image. The development roller includes a body, a member frictionally welded to the body, and a shaft attached to the member.

In accordance with still another aspect of the present invention, there is provided a process for manufacturing a development roller for use in a machine in which marking particles are advanced toward a latent image to form a developed image. The process includes the steps of providing a body, frictionally welding a member to the body, and attaching a shaft to the member.

The applicant has discovered that a cylindrical roller assembly with a cylindrical ceramic periphery and with opposed precision journals can be produced using a solid state welding process. The solid state welding process is a process in which materials are joined by combination of relative motions between an adjoining surface. Often such a solid state process also includes the use of a force or pressure directed toward the area where the relative motion between the components occurs.

Friction welding can be used to join a wide range of similar and dissimilar materials. Such materials that may be friction welded include metals, ceramics and plastics. Some materials such as steel, may be welded to similar steel materials as well as for aluminum, other materials may not be successfully friction welded. For example, steel may not be successfully friction welded to ceramic materials.

The applicant has found that a low cost, high quality donor roll for an electrostatographic developing unit may be fabricated by utilizing a ceramic body as well as steel journals utilizing a friction welding technique if aluminum is placed between the ceramic and the steel. This configuration may be friction welded because aluminum may be friction welded to ceramic and steel may be friction welded to aluminum.

Inasmuch as the art of electrophotographic printing therein in which the solid state welded donor roll of the present invention is suited is well known, the various processing stations employed in the printing machine will be shown hereinafter schematically and their operation described briefly with reference thereto.

Figure 5:
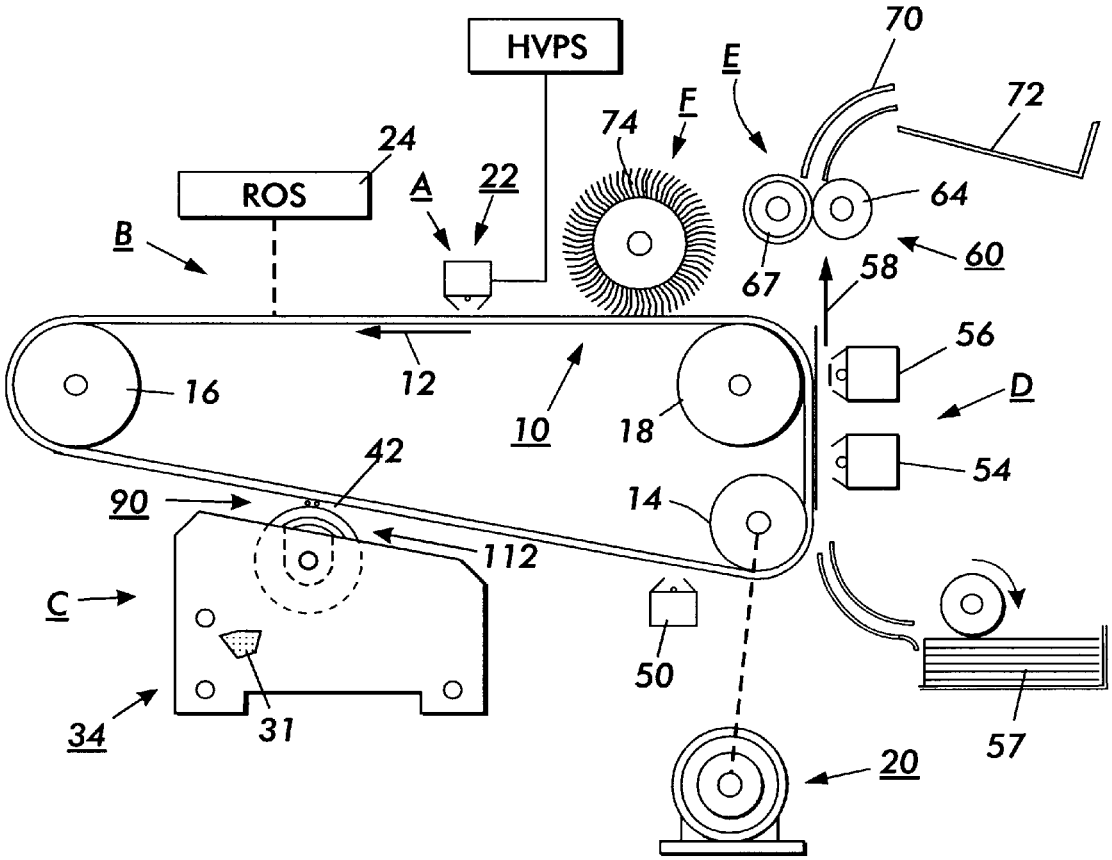
FIG. 5 is a schematic elevational view of an illustrative electrophotographic printing or imaging machine or apparatus incorporating a development apparatus having the solid state welded ceramic donor roll of the present invention therein.

Referring initially to FIG. 5, there is shown an illustrative electrophotographic machine having incorporated therein a solid state welded donor roll 42 of the present invention. An electrophotographic printing machine creates an image in a single pass through the machine and incorporates the features of the present invention. It should be appreciated that the present invention may be utilized in an electrophotographic printing machine which utilizes an image on image process to create a color image in a single pass through the machine. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential. The device 22 is powered by a high voltage power supply (HVPS).

After passing through the charging station A, the now charged image area passes through an exposure station B. At exposure station B, the charged image area is exposed to light which illuminates the image area with a light representation of a black image. That light representation discharges some parts of the image area so as to create an electrostatic latent image. While the illustrated embodiment uses a laser based output scanning device 24 or raster output scanner (ROS) as a light source, it is to be understood that other light sources, for example an LED printbar, can also be used with the principles of the present invention. It should also be appreciated that the present invention may be practiced in a light lens machine in which an image is formed by passing light through an original document to expose the photoconductive surface.

After passing through the first exposure station B, the now exposed image area passes through a development station C. The development station C deposits an image, of negatively charged toner 31 onto the image area. That toner is attracted to the less negative sections of the image area and repelled by the more negative sections. The result is a first toner powder image on the image area.

The development station C, which incorporates a donor roll 42 in development system 34. Electrode grid 90 is electrically biased with an AC voltage relative to donor roll 42 for the purpose of detaching toner therefrom so as to form a toner powder cloud 112 in the gap between the donor roll and photoconductive surface. Both electrode grid 90 and donor roll are biased at a DC potential for discharge area development (DAD). The discharged photoreceptor image attracts toner particles from the toner powder cloud to form a toner powder image thereon.

After passing the corotron member 50, the toner powder image is transferred from the image area onto a support sheet 57 at transfer station D. It is to be understood that the support sheet is advanced to the transfer station in the direction 58 by a conventional sheet feeding apparatus which is not shown. The transfer station D includes a transfer corona device 54 which sprays positive ions onto the backside of sheet 57. This causes the negatively charged toner powder images to move onto the support sheet 57. The transfer station D also includes a detack corona device 56 which facilitates the removal of the support sheet 57 from the photoreceptor belt 10.

After transfer, the support sheet 57 moves onto a conveyor (not shown) which advances that sheet to a fusing station E. The fusing station E includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute 70 guides the support sheets 57 to a catch tray 72 for removal by an operator.

After the support sheet 57 has separated from the photoreceptor belt 10, residual toner particles on the image area are removed at cleaning station F via a cleaning brush 74 contained in a housing (not shown). The image area is then ready to begin a new marking cycle.

The various machine functions described above are generally managed and regulated by a controller which provides electrical command signals for controlling the operations described above.

Figure 4:
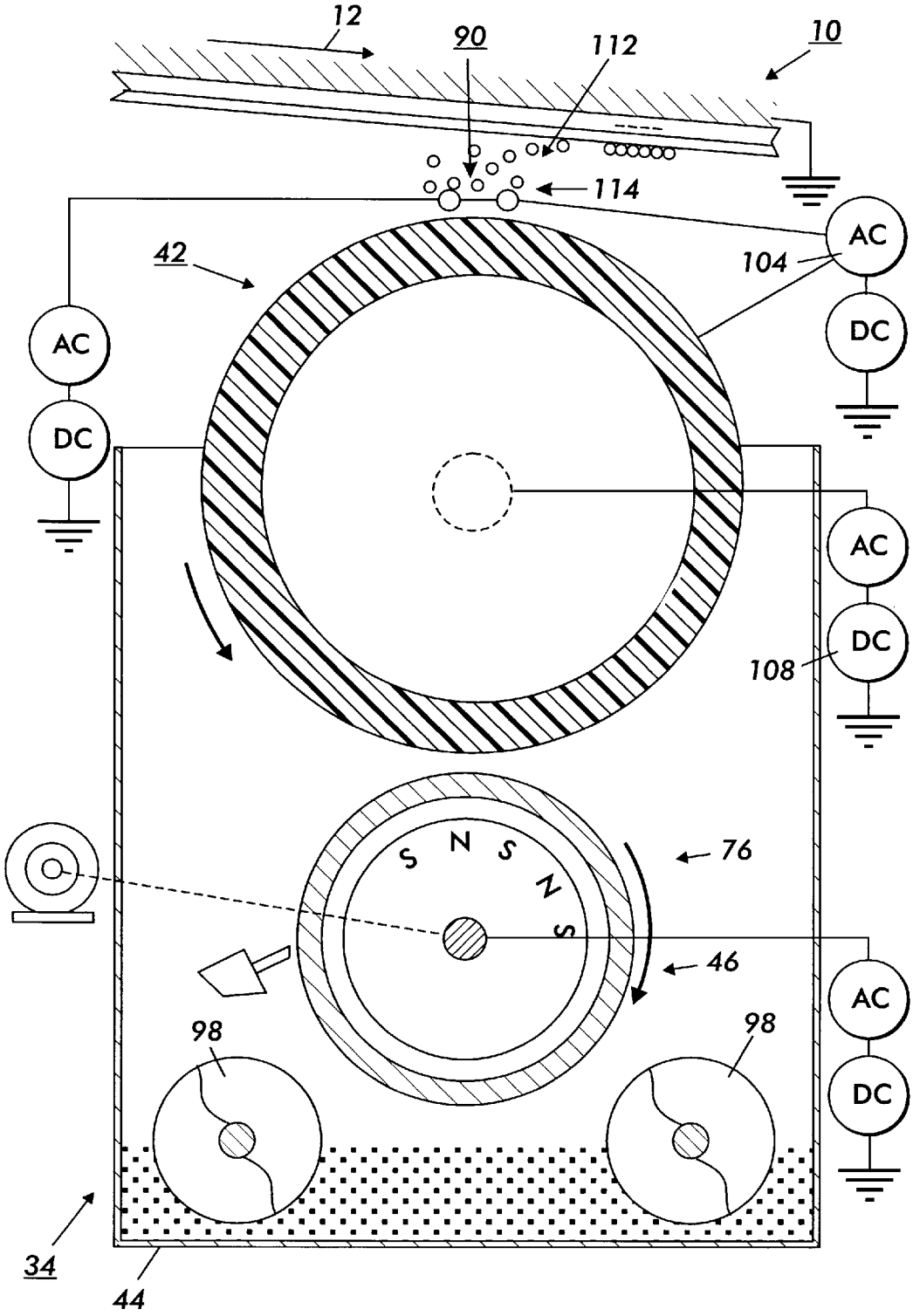
FIG. 4 is a schematic elevational view showing the development apparatus used in the FIG. 5 printing machine.

Referring now to FIG. 4 in greater detail, the development system 34 is scavengeless, meaning that the developer or toner from system 34, which is delivered to development zone 114, must not interact significantly with an image already formed on the image receiver 10. Thus, the system 34 is also known as a non-interactive development system. The development system 34 comprises a donor structure in the form of a roller 42, which conveys a toner layer to the region under the wire assembly 90. The toner layer can be formed on the donor roll 42 by either a two component developer (i.e. toner and carrier) or a single component developer (toner only). The development zone contains an AC biased electrode structure 90 self-spaced from the donor roll 42 by the toner layer. The toner deposited on donor roll 42 may be positively or negatively charged. The donor roll 42 may be coated with a ceramic coating, or with TEFLON-S (trademark of E. I. duPont De Nemours) loaded with carbon black.

For donor roll loading with two component developer, a conventional magnetic brush 46 can be used for depositing the toner layer onto the donor structure, as illustrated in U.S. Pat. No. 4,868,600.

For single component loading of donor roll 42, the combination metering and charging device may comprise any suitable device for depositing a monolayer of well charged toner onto the donor structure 42. For example, it may comprise an apparatus such as described in U.S. Pat. No. 4,868,600 wherein the contact between weakly charged toner particles and a triboelectrically active coating contained on a charging roller results in well charged toner. Other combination metering and charging devices may be employed.

With continued reference to FIG. 4, augers, indicated generally by the reference numeral 98, are located in chamber 76 of housing 44. Augers 98 are mounted rotatably in chamber 76 to mix and transport developer material. The augers have blades extending spirally outwardly from a shaft. The blades are designed to advance the developer material in the axial direction substantially parallel to the longitudinal axis of the shaft. As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are in the chamber of the developer housing with the toner particles having a constant charge.

The electrode structure 90 is comprised of one or more thin (i.e. 50 to 100 mm diameter) tungsten or stainless steel wires which are lightly positioned against the toner on the donor structure 42. The distance between the wires and the donor is self-spaced by the thickness of the toner layer which is approximately 25 mm. The extremities of the wires are supported by end blocks (not shown) at points slightly below a tangent to the donor roll surface. Mounting the wires in such manner makes the self-spacing insensitive to roll runout. A suitable scavengeless development system for incorporation in the present invention is disclosed in U.S. Pat. No. 4,868,600. As disclosed in the '600 patent, a scavengeless development system may be conditioned to selectively develop one or the other of the two image areas (i.e., discharged and charged image areas) of the images by the application of appropriate AC and DC voltage biases to the wires in electrode structure 90 and the donor roll structure 42.

An AC power source 104 applies an electrical bias of, for example, 1000 volts peak-to-peak at 4 kHz between the electrode structure 90 and the donor roll 42. A DC bias from 0 to −400 volts is applied by a DC power source 108 to the donor roll 42. The AC voltage applied between the set of wires 90 and the donor structure 42 establishes AC fringe fields serving to liberate toner particles from the surface of the donor structure 42 to form the toner cloud 112 in the development zone 114. The electric field which exists in the development zone 114, due to the electrostatic image, the charged toner layer on the donor roll and the voltages applied to the electrode structure 90 and the donor roll 42, controls the deposition of toner onto the image receiver.

Figure 1:
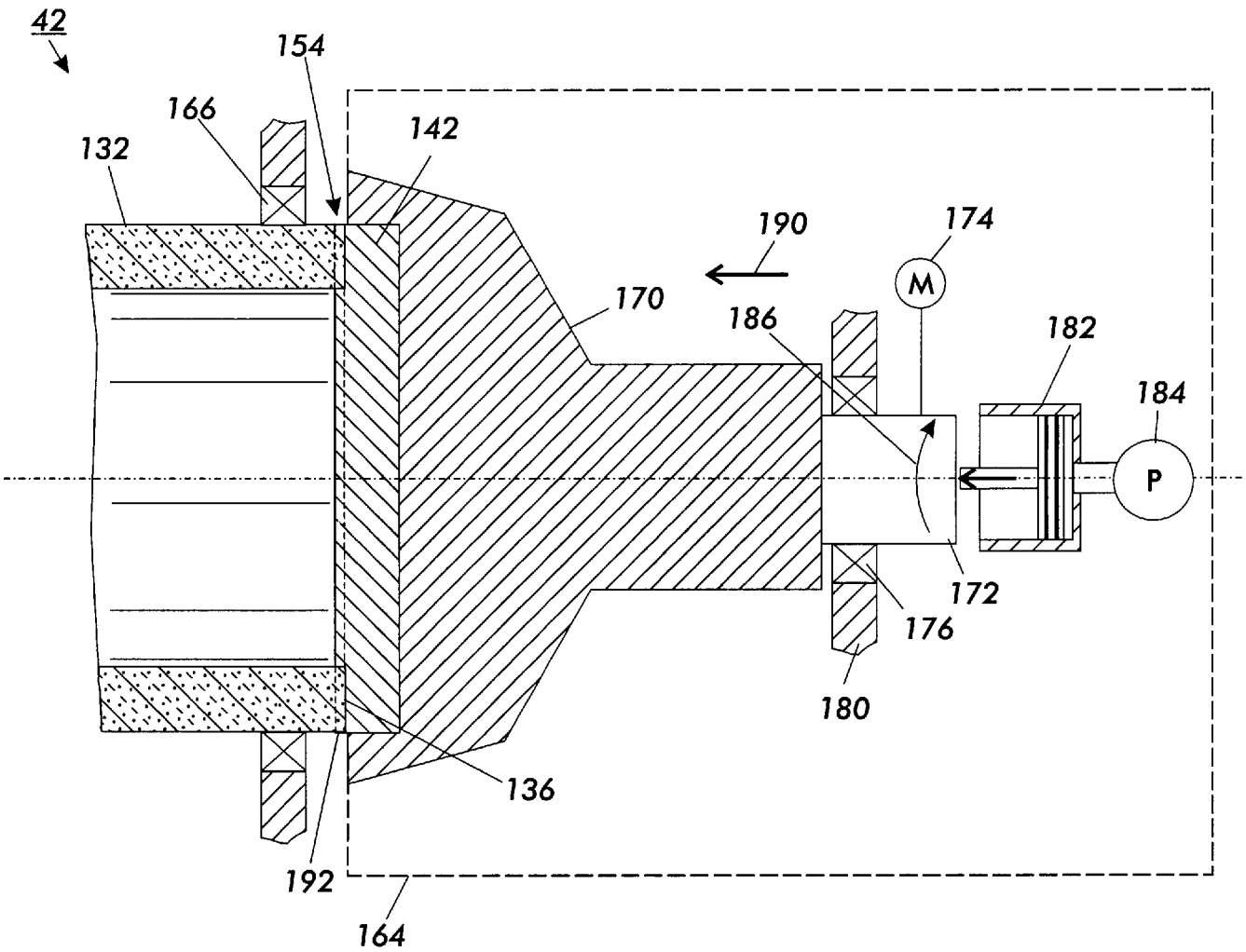
FIG. 1 is a cross sectional view of the donor roll of FIG. 2 along the line 1—1 in the direction of the arrows for use in the FIG. 4 development apparatus including the inertia welded ceramic donor roll according to the present invention.

According to the present invention and referring to FIG. 1, a development roller 42 in the form of a donor roller is shown.

Figure 2:
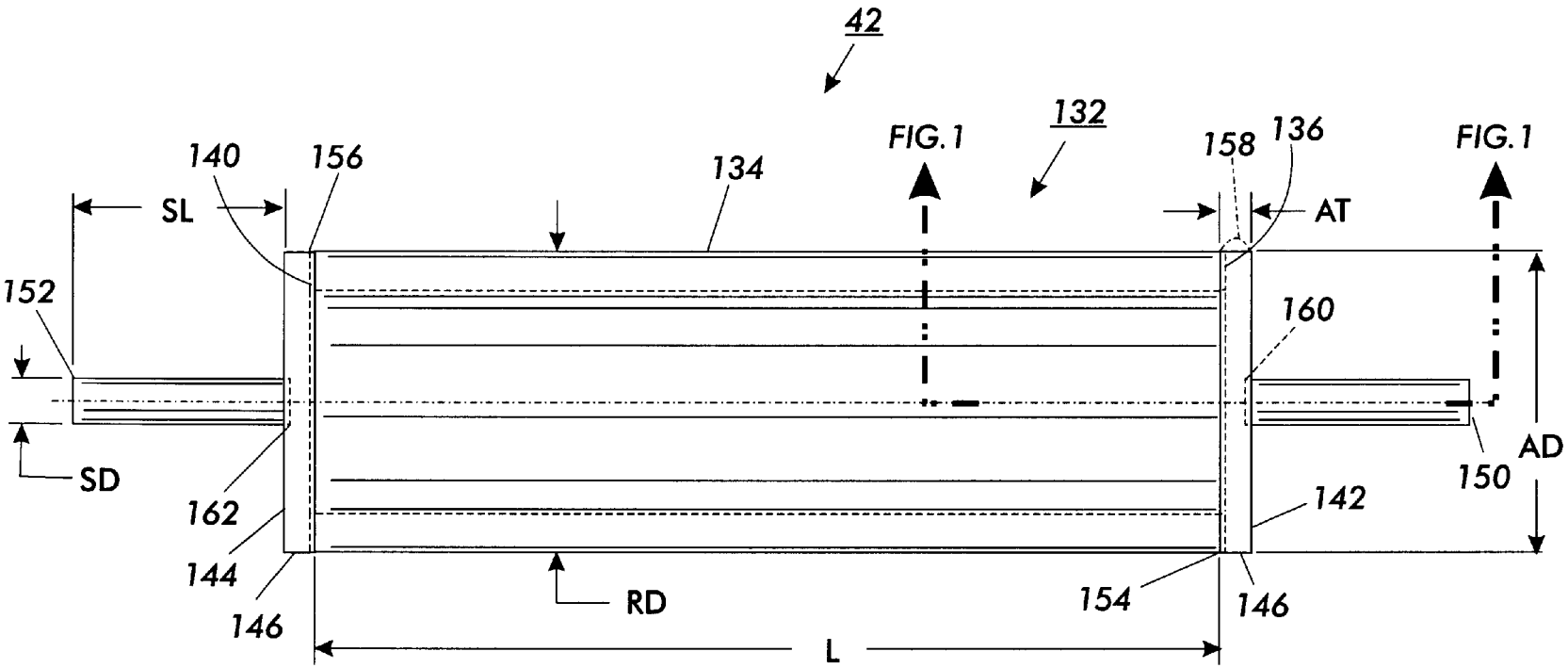
FIG. 2 is a plan view of the solid state welded ceramic donor roll according to the present invention with a tubular cylindrical ceramic core.

Referring now to FIG. 2, the development roller 42 in the form of the donor roll is shown in greater detail. The roller 42 includes a ceramic body 132. As shown in FIG. 2, the ceramic body 132 preferably has a generally cylindrical outer periphery 134. Further, the ceramic body 132 preferably includes a first face 136 and a second face 140 parallel to and opposed to the first face 136.

The ceramic body 132 may have any size. For a roller 42 utilizing a xerographic process the roller 42 preferably has a width sufficient to provide for development of the width of the substrate which is developed on the copy or printing machine. In that a common sheet size is 8½×11 inches in the United States or letter size, or A4 size in Europe and Japan, a roller 42 utilized for such paper thus has a length greater than the width of such copy sheet. The roller 42 thus may have a length L of for example, nine inches. It should be appreciated that for processing a sheet being fed through the paper path in a direction with the longitudinal distance of the sheet perpendicular to the paper path, a length L of approximately 11.5 inches or greater may be required. The roller 42 may have any diameter RD sufficient to advance marking particles toward the copy substrate to effectuate proper development of the substrate. For example, and as shown in FIG. 2, the roller 42 may have a roller diameter RD of for example approximately one inch.

The ceramic body 132 may be manufactured in any suitable commercially available process from any suitable ceramic material. For example, the ceramic body 132 may be made by Die Pressed.

The chemical composition of the ceramic body is preferably selected to meet the required electrical properties of the roller 42. For example, for a hybrid scavengeless development donor roll, the ceramic body 132 has semi-conductive properties. The composition of such a semi-conductive roll for use in a HSD development is more fully described in U.S. Pat. No. 5,473,418 to Kazakos incorporated herein in its entirety by reference.

The roller 42 further includes an aluminum member 142 attached to the ceramic body 132. The aluminum member 142 is secured to first face 136 of the body 132. Preferably and as shown in FIG. 2, the roller 42 further includes a second aluminum member 144 which may be identical to the first aluminum member 142. The second aluminum member 144 is attached to the ceramic body 132 at second face 140 at the body 132. The first aluminum member 142 and the second aluminum member 144 may have any suitable shape capable of attachment to the ceramic body 132.

As shown in FIG. 2 for simplicity and to properly cooperate with the ceramic body 132, the first aluminum member 142 and the second member 144 have a disc shape with an outer periphery 146 defined by diameter AD and a thickness AT. Preferably and as shown in FIG. 2, the diameter AD of the members 142 and 144 is preferably similar to diameter RD of the periphery 134 of the ceramic body 132.

The thickness AT of the first aluminum member 142 and the second aluminum member 144 should be large enough to provide ample rigidity and strength for the roller 42. The thickness AT should be small enough such that the mass of the members 142 and 144 is small enough to provide for efficient attachment of the members 142 and 144 to the ceramic body 132. An unduly large thickness AT of the members 142 and 144 may require excessive energy to heat the members 142 and 144 sufficiently to adequately secure the members 142 and 144 to the body 132.

The roller 42 further includes a shaft 150. The first shaft 150 is attached to the first aluminum member 142. Preferably and as shown in FIG. 2, the first shaft 150 extends outwardly from the member 142.

Preferably and as shown in FIG. 2, the roller 42 further includes a second shaft 152. The second shaft 152 extends outwardly from and is attached to the second member 144.

The shafts 150 and 152 may be made of any suitable durable material capable of attachment to the aluminum members 142 and 144. Preferably the shafts 150 and 152 are made of a material that is not chemically reactive with marking particles. Further, to provide adequate rotational support for the roller 42, the shafts 150 and 152 are made of a material that provides for a suitable rotating wear surface for the roller 42. Such a suitable material may be stainless steel. One particular stainless steel which is suitable for this application is 416 SS.

The shafts 150 and 152 may have any suitable size and may be identical to each other. For example, the shafts 150 and 152 may have a length SL of, for example two inches. The shafts 150 and 152 may have a diameter SD of, for example, 0.375 inches.

Preferably and according to the present invention, the roller 42 is manufactured utilizing solid state welding technology. The aluminum members 142 and 144 may be solid state welded to the ceramic body 132. Likewise, the first and second shafts 150 and 152 may be solid state welded to the first aluminum member 142 and the second aluminum member 144 respectively. While it should be appreciated that the present invention may be practiced when utilizing the solid state welding process for either welding the body 132 to the members 142 and 144 or for welding the members 142 and 144 to the shafts 150 and 152, respectively, preferably the members 140 and 142 are solid state welded to the body 132 as well as to the shafts 150 and 152, respectively.

The roller 42 as shown in FIG. 2 thus preferably has four solid state welding areas. A first body welding area 154 is located between the ceramic body 132 and the first member 142. A second body weld area 156 is located between the ceramic body 132 and the second member 144. A first shaft weld area 160 is located between the first shaft 150 and the first member 142. A second shaft weld area 162 is located between the second shaft 152 and the second member 144.

Each of the weld areas or welds 154, 156, 160 and 162 are preferably made from a solid state welding process. Such solid state welding processes include diffusion and friction welding. The friction welding process will be described in greater detail in that the applicant believes friction welding to be the most commercially feasible of the processes for solid state welding of the roller 42. Friction welding is a solid state welding process that produces a weld under compressive force contact of workpieces rotating or moving relative to one another to produce heat and plastically displace material from the adjoining surfaces.

The basic steps in friction welding include step 1 which is having one workpiece rotated and the other held stationary. When the appropriate rotational speed is reached, the two workpieces are brought together and an axial force is applied. In step 2, rubbing at the interface between the two workpieces heats the workpiece locally and the upsetting starts. Finally, rotation of one of the workpieces stops and the upsetting is complete.

The friction welding at the four weld areas 154, 156, 160 and 162 may be accomplished by either of two methods of supplying energy within a frictional welding process. The two methods of supplying energy within a frictional welding process are direct drive friction welding which may also be called conventional frictional welding and inertial friction welding. Conventional friction welding utilizes a continuous input of pressure and rotational speed while inertia friction welding may also be called fly wheel friction welding and utilizes energy stored in a fly wheel which when fully dissipated ends the welding process.

Typically in direct drive friction welding, one of the workpieces is attached to a motor driven unit while the other is restrained from rotation. The motor driven workpiece is rotated at a predetermined constant speed. The workpieces to be welded are moved together and then a frictional welding force is applied. After a predetermined time or when a preset amount of upset takes place between the workpieces, the rotational driving force is discontinued. Pressure is applied to the two workpieces for a predetermined time after rotation ceases.

In inertia friction welding, one of the workpieces is connected to a fly wheel and the other is restrained from rotation. The fly wheel is accelerated to a predetermined rotational speed which stores the required energy. The drive motor is disengaged and the workpieces are forced together by a frictional welding force. After the kinetic energy is fully dissipated, the rotating workpiece stops. After the relative rotation of the workpieces ends, a force is applied to the workpieces to complete the process. The friction welding process is more fully described in Welding Handbook, Volume 2, American Welding Society, incorporated in its entirety herein by reference.

While either the direct drive welding or inertia drive welding may be effective in providing a solid state welded roll according to the present invention, the applicant believes that a direct drive welding process may be more suitable for the present invention. While inertia drive welding affords the benefits of a less expensive and less complicated friction welding machine and provides for fewer process parameters to be controlled within a production facility, the fewer controllable process parameters available within the inertia drive welding process, the applicant believes, may provide insufficient flexibility to optimize a process suitable for the present invention.

While the present invention will be described utilizing solid state or friction welding with one of the two workpieces rotated about an axis of symmetry and with the other workpiece stationary, it should be appreciated that alternate relative motions may be utilized within the present invention. For example, besides the conventional or most commonly used mode in which one workpiece rotates while the other remains stationary, an additional mode commonly called a counterrotation provides for both workpieces to be rotated. The workpieces are rotated in opposite directions. Counter rotations are typically utilized for workpieces with very small diameters to provide additional rotational speed.

Another relative motion mode is utilized when two stationary workpieces push against a rotating piece positioned between them. This mode is desirable if the two end parts are long or an awkward shape and would therefore be difficult to rotate.

Another mode involves two rotating pieces pushing against a stationary piece at the middle. This mode is commonly known as twin welds. Utilizing a twin weld mode may permit the first and second aluminum member to be welded to the ceramic body simultaneously. The twin weld mode may also permit the welding of both the first shaft and the second shaft simultaneously. Additional capital expense for acquiring more complicated equipment may be required with the use of the twin weld mode.

According to the present invention and referring now to FIG. 1, the roller 42 is shown mounted in a direct drive friction welding machine 164. While it should be appreciated that the aluminum member may be held stationary and the ceramic body and shaft rotated simultaneously to provide the friction welded assembly, to reduce capital equipment costs and to provide for a simpler more robust process, the shaft and the body are preferably welded to the aluminum member separately.

While it should be appreciated that the shaft may first be welded to the aluminum member and the shaft aluminum member assembly then welded to the ceramic body as shown in FIG. 1, the aluminum member is first welded to the ceramic body and the shaft is then welded to the aluminum member.

As shown in FIG. 1, the body 132 is preferably mounted to a stationary workpiece mounting device 166. The mounting device 166 may be an adjustable mechanical chuck. The direct drive friction welding machine 164 is utilized to friction weld both the first member 142, as shown in FIG. 1, as well as the second member 144 (see FIG. 2). After the first member 142 is welded by the welding machine 164, the body 132 of the roller 42 is rotated end for end and the second member 144 is welded to the body 132.

As shown in FIG. 1, the first aluminum member 142 is positioned concentric with the ceramic body 132 against first face 136 of the body 132. The first aluminum member 142 is supported by a rotating workpiece mounting device 170. The mounting device 170 may be, for example, in the form of a mechanical chuck. The welding machine 164 includes a arm 172 which is positioned concentric with the member 142 and the body 132, the arm 172 is rotated by motor 174 and is supported by bearings 176 around frame 180. A cylinder 182 applies pressure against the arm 172. The cylinder 182 is actuated by a pressure source 184. The arm 172 is connected to the member chuck 170 and the member chuck 170 rotates with the arm 172.

For example, to perform the welding operation, an operator places the body 132 of the roller 42 in the body chuck 166. Similarly, a member 142 is positioned in the member chuck 170. The operator then begins the initiation of the cycle of the welding machine 164. The arm 172 then begins to rotate in the direction of arrow 186. It should be appreciated that the arm 172 may likewise rotate in a direction opposite to that shown in FIG. 1. The rotational speed of the arm 172 may be from about 800 rpm to about 1600 rpm. It should be appreciated that higher rotational speed is desirable for smaller workpieces and lower rotating speeds are desirable for larger workpieces.

The arm 172 then advances in the direction of arrow 190 urging the first member 142 against first face 136 of the body 132. The cylinder 182 applies a pressure from the pressure source 184 against the arm 172. The pressure from the pressure source 184 may be from about 200 psi to about 2,000 psi. The combination of pressure and relative motion between the member 142 and the body 132 forms a solid state friction weld 192 therebetween.

After the arm 172 is advanced completely in the direction of arrow 190, the cylinder 182 continues to apply pressure from the pressure source 184 against the arm 172 for a predetermined period of time. The arm 172 is then returned in a direction opposite the arrow 190 to its initial position. The body 132 with the member 142 attached thereto is then removed from the chucks 166 and 170. The roller 42 is then rotated end for end and the second member 144 is then applied to the second face 140 of the body 132.

Figure 6:
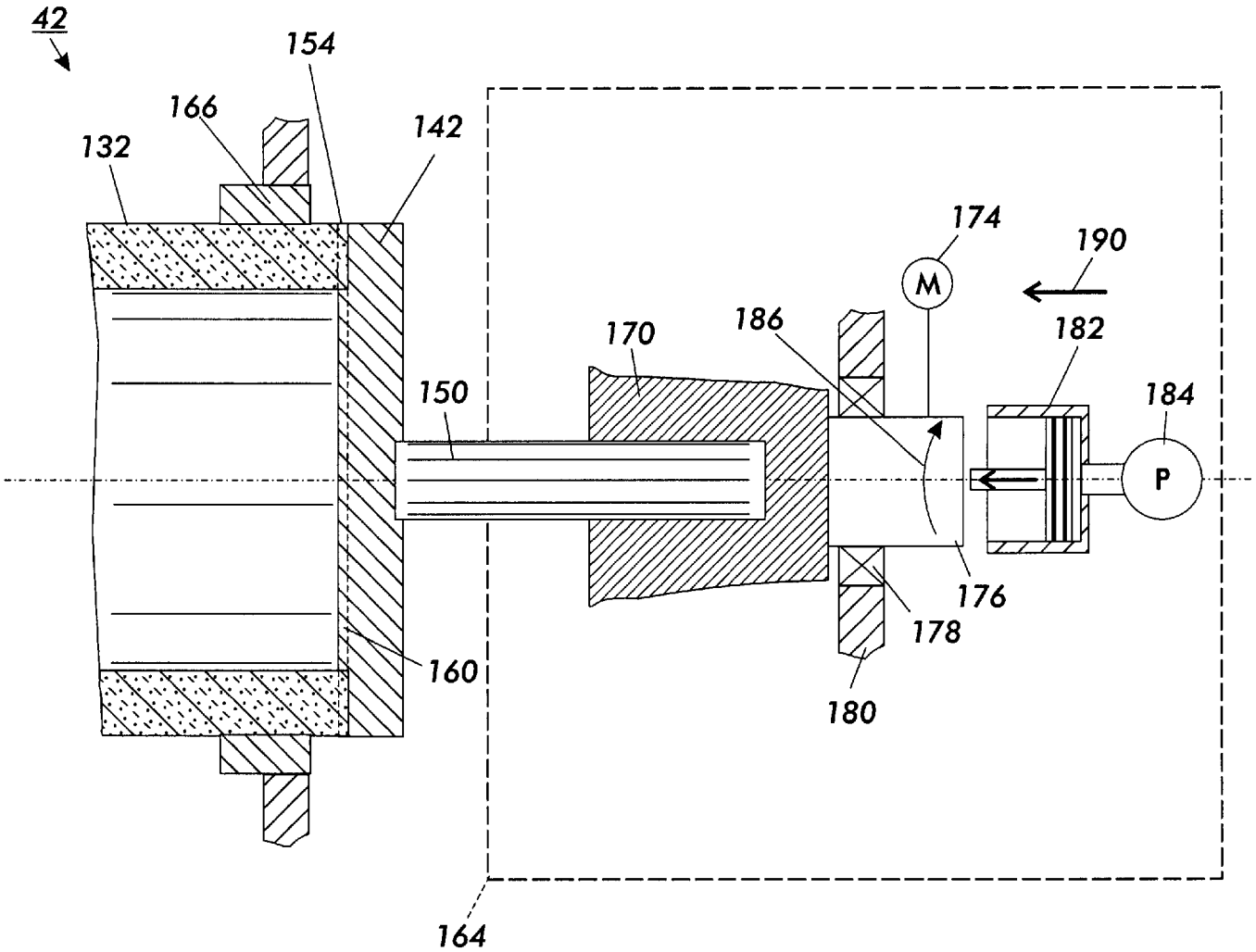
FIG. 6 is a partial plan view partially in cross section of an end cap subassembly for use as a portion of the solid state welded ceramic donor roll of FIG. 2.

Referring now to FIG. 6, the inertia welding machine 164 is shown for use in welding the first shaft 150 to the first member 142. It should be appreciated that the welding machine 164 may similarly weld the second shaft 152 to the second member 144 in a similar manner.

The welding machine 164 as shown in FIG. 6 may be identical to the inertia welding machine 164 as shown in FIG. 1, except that member chuck 170 is adjusted to secure the first shaft 150 which may be significantly smaller in diameter than the first member 142.

The operation of the welding machine 164 when friction welding the first shaft 150 to the first member 142 is similar to the operation of the machine 164 when used welding the first member to the body 132 as shown in FIG. 1. For example, the operator places the roller 42 including the body 132 and the first member 142 in the body chuck 166. The operator then places the first shaft 150 in the member chuck 170. Next, the cycle of the friction welding machine 164 is initialized. The ram 176 then rotates in the direction of arrow 186 causing the member chuck 170 and the shaft 150 to rotate in the direction of arrow 186. The cylinder 182 then advances the ram 176 in the direction of arrow 190 causing the first shaft 150 to have relative motion with the first member 142.

The rotational speed of the ram 176 may be, for example, from 800 rpm to 1600 rpm. If the shaft 150 is quite small, the rotational speed of the shaft may need to be increased. The pressure applied by the cylinder 182 may be, for example, from 200 to 2,000 psi. After a specified period of time, the rotation of the first shaft 150 is discontinued. After the rotation of the shaft 150 has ended, the pressure applied by the cylinder 182 continues for a specified period of time.

After the first shaft friction weld area 160 is fully formed, the roller 42 is removed from the body chuck 166 and the member chuck 170 and the roller 142 is rotated end for end to perform the welding operation on the second shaft 152.

Figure 3:
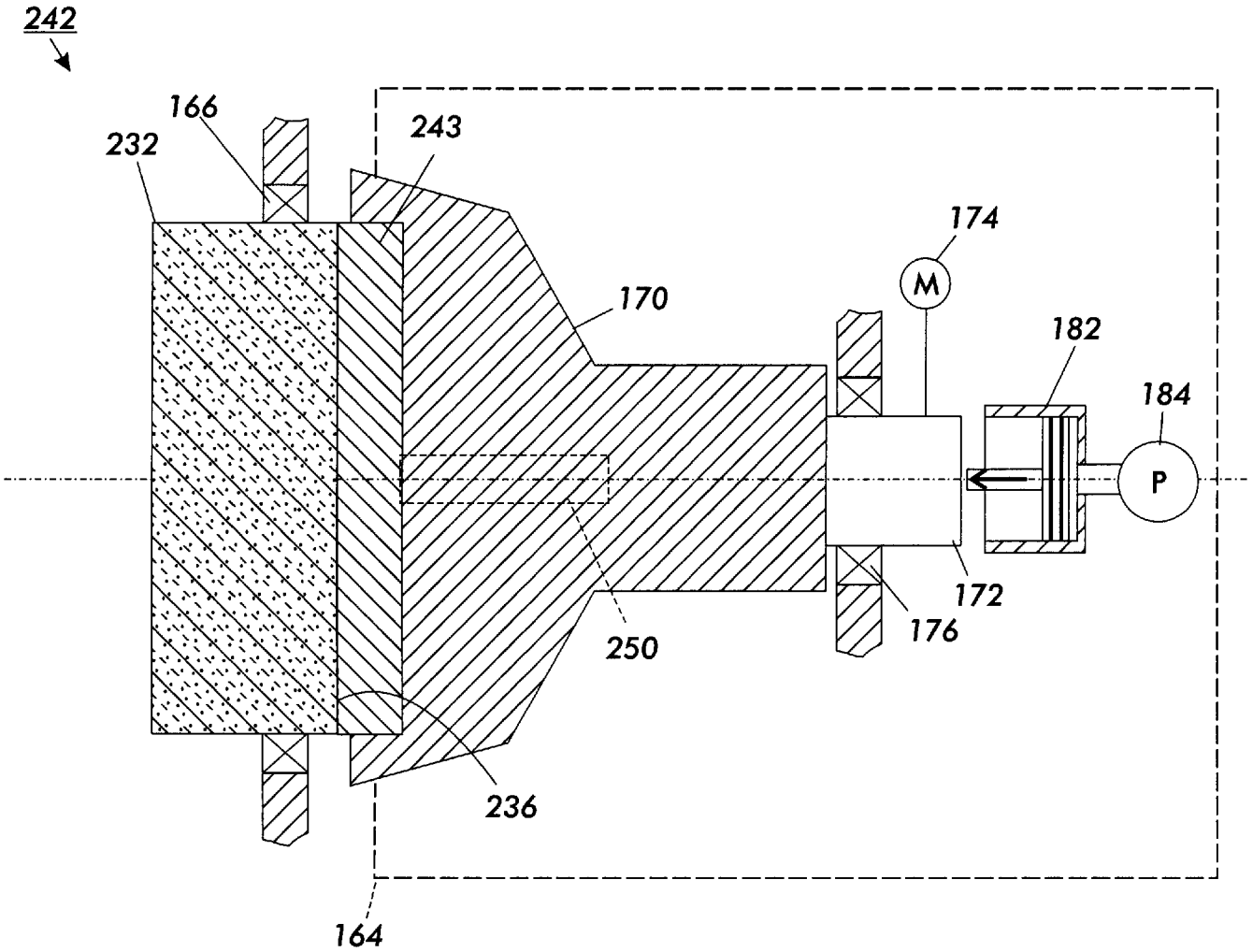
FIG. 3 is a partial plan view partially in cross section of an alternate embodiment of an solid state welded ceramic donor roll according to the present invention with a solid cylindrical ceramic core.

Referring now to FIG. 3, an alternate embodiment of the present invention is shown as roller 242. The roller 242 is similar to roller 42 of FIGS. 1, 2, and 6, except that the roller 242 includes a body 232 which is solid. The roller 242 includes an aluminum member 243 which, while shown in FIG. 3 located only on a first end 236 of the body 232, is likewise located on the opposite end of the roller 242. The member 242 may be identical to the first member 142 of the present invention.

The roller 242 further includes a shaft 250, shown in phantom, extending outwardly from the first aluminum member 243. The shaft 250 is similar to the shaft 150 of FIGS. 1, 2, and 6. A second shaft (not shown) which may be identical to shaft 250 exists on the opposite end of the roller 242 extending outwardly from a second aluminum member (not shown) which may be identical to first aluminum member 243.

The roller 242 may be manufactured utilizing the direct drive friction welding machine 164 of FIGS. 1 and 6. The body chuck 166 of the machine 164 may be utilized to secure the body 232 while the member chuck 170 may be utilized to hold and rotate the member 243. The operation of the friction welding machine 164 when welding the roller 242 is similar to the process more fully described with regard to FIGS. 1 and 6.

Referring again to FIG. 2, the roller 42, after being assembled by the frictional welding process described, may be further machined. For example the periphery 134 of the ceramic body 132 may be precision ground. The grinding may also include grinding outer portions of the aluminum members 142 and 144. Machining the members 142 and 144 may remove protrusions 158, shown in phantom, caused during the friction welding process. Further, the peripheries of the shafts 150 and 152 may be precision ground with the periphery 134 of the body 132.

Further, centers may extend inwardly from outer faces of the shafts 150 and 152. The centers may be utilized to provide surfaces for the rotation of the roller 42. The roller 42 may then have the ceramic body 132 as well as the outer periphery of the shafts 150 and 152 ground simultaneously. Alternatively, the outer peripheries of the roller 42 may be simultaneously ground on a centerless grinding machine. Such subsequent precision grinding operators may provide for very precise geometries of the roller 42 required for hybrid scavengeless development.

By providing a solid state welding ceramic roll including aluminum members positioned between the ceramic body and the shafts, an inexpensive shaft assembly may be provided.

By providing a shaft assembly utilizing a solid ceramic body, a ceramic surface may be provided which has a formulation with greater oxide consistency. Such an improved oxide consistency provides for reduced porosity, improved surface finish, reduced arcing and a more consistent time constant or semiconductive properties.

By providing aluminum portions between a ceramics and steel shafts, a steel journal ceramic roller can be provided with lower cost than the prior art press fitted roll assemblies.

It is, therefore, apparent that there has been provided in accordance with the present invention, a guard that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A roller comprising:

an elongated ceramic body having a first end and a second end;

an aluminum member attached to each of said first end and said second end of said elongated ceramic body; and two elongated shafts, wherein a shaft is attached to and extending from each of said aluminum members;

wherein the two elongated shafts are made of a different material than the aluminum members.

2. A roller according to claim 1, wherein said shafts comprises a stainless steel.

3. A roller according to claim 1:

wherein at least one of said ceramic body and said shaft are friction welded to said aluminum member.

4. A roller according to claim 1:

wherein said ceramic body comprises a generally cylindrical shape with first and second opposed parallel ends;

wherein said aluminum member extends outwardly from said first end;

wherein said shaft extends outwardly from said aluminum member;

further comprising a second aluminum member extending outwardly from said second end; and further comprising a second shaft extending outwardly from said second aluminum member.

5. The roller of claim 1 wherein the elongated ceramic body is at least one of solid cylinder and a cylindrical tube.

6. The roller of claim 5 wherein the elongated ceramic body consists essentially of a ceramic material.

7. A development roller for use in a machine in which marking particles are advanced toward a latent image to form a developed image, said development roller comprising:

an elongated ceramic body having two ends;

a member frictionally welded to each of said ends of said elongated ceramic body; and a shaft attached to each of said members;

wherein the shafts are made of a different material than the members.

8. A development roller according to claim 7, wherein:

said shafts comprises a stainless steel; and said members comprises an aluminum.

9. A development roller according to claim 7, wherein:

said shaft comprises a metal; and said shaft is friction welded to said member.

10. A development roller according to claim 7:

wherein said elongated ceramic body comprises a generally cylindrical shape with first and second opposed parallel ends;

wherein said member extends outwardly from said first end;

wherein said shaft extends outwardly from said member;

further comprising a second member extending outwardly from said second end; and further comprising a second shaft extending outwardly from said second member.

11. The development roller according to claim 7 wherein the elongated ceramic body is at least one of solid cylinder and a cylindrical tube.

12. A development unit for use in a printing machine in which marking particles are advanced toward a latent image to form a developed image, said development unit comprising:

a housing defining a chamber therein for storing a supply of marking particles therein, said housing defining an aperture therein; and a development roller rotatably mounted to said housing and positioned adjacent the aperture, said development roller adapted to advance said marking particles from the chamber toward the latent image, said development roller including an elongated ceramic body having two ends, a member frictionally welded to each end of said elongated ceramic body, and a shaft attached to each of said members wherein the shafts are made of a different material than the members.

13. A development unit according to claim 12, wherein:

said shafts comprises a stainless steel; and said member comprises an aluminum.

14. A development unit according to claim 12, wherein:

said shaft comprises a metal; and said shaft is friction welded to said member.

15. A development unit according to claim 12:

wherein said elongated ceramic body comprises a generally cylindrical shape with first an second opposed parallel ends;

wherein said member extends outwardly from said first end;

wherein said shaft extends outwardly from said member;

further comprising a second member extending outwardly from said second end; and further comprising a second shaft extending outwardly from said second member.

16. An electrophotographic printing machine of the type in which marking particles are advanced toward a latent image to form a developed image, said printing machine including a development unit, said development unit comprising:

a housing defining a chamber therein for storing a supply of marking particles therein, said housing defining an aperture therein; and a development roller rotatably mounted to said housing and positioned adjacent the aperture, said development roller adapted to advance said marking particles from the chamber toward the latent image, said development roller including an elongated ceramic body having two ends, a member frictionally welded to each end of said elongated ceramic body, and a shaft attached to each of said members wherein the shafts are made of a different material than the members.

17. A printing machine according to claim 16, wherein:

said shafts comprises a stainless steel; and said member comprises an aluminum.

18. A printing machine according to claim 16, wherein:

said shaft comprises a metal; and said shaft is friction welded to said member.

19. A printing machine according to claim 16:

wherein said elongated ceramic body comprises a generally cylindrical shape with first and second opposed parallel ends;

wherein said member extends outwardly from said first end;

wherein said shaft extends outwardly from said member;

further comprising a second member extending outwardly from said second end; and further comprising a second shaft extending outwardly from said second member.

* * * * *